US009668532B2

(12) United States Patent
Handfield et al.

(10) Patent No.: US 9,668,532 B2
(45) Date of Patent: Jun. 6, 2017

(54) HELMET CHIN CURTAIN

(71) Applicant: KIMPEX INC., Drummondville, quebec (CA)

(72) Inventors: Robert Handfield, St-Lucien (CA); Nicolas Bouchard-Fortin, Sherbrooke (CA)

(73) Assignee: KIMPEX INC., Drummonville (CA)

( * ) Notice: Subject to any disclaimer, the term of this patent is extended or adjusted under 35 U.S.C. 154(b) by 37 days.

(21) Appl. No.: 14/598,934

(22) Filed: Jan. 16, 2015

(65) Prior Publication Data

US 2015/0196081 A1 Jul. 16, 2015

Related U.S. Application Data

(60) Provisional application No. 61/928,185, filed on Jan. 16, 2014.

(51) Int. Cl.
*A42B 3/32* (2006.01)
*A42B 3/10* (2006.01)

(52) U.S. Cl.
CPC ..... *A42B 3/326* (2013.01); *A42B 3/105* (2013.01)

(58) Field of Classification Search
CPC ..... A42B 3/105; A42B 3/326
See application file for complete search history.

(56) References Cited

U.S. PATENT DOCUMENTS

| | | | | | |
|---|---|---|---|---|---|
| 5,095,550 | A * | 3/1992 | Perlinger | A42B 3/105 | 2/410 |
| 5,412,810 | A * | 5/1995 | Taniuchi | A42B 3/283 | 2/410 |
| 6,289,521 | B1 * | 9/2001 | Ikeda | A42B 3/105 | 2/421 |
| 6,862,750 | B1 * | 3/2005 | Rasberry | A42B 3/08 | 2/421 |
| 2013/0340148 | A1 * | 12/2013 | Arai | A42B 3/326 | 2/421 |

* cited by examiner

*Primary Examiner* — Anna Kinsaul
(74) *Attorney, Agent, or Firm* — Brouillette Legal Inc.; Robert Brouillette

(57) ABSTRACT

A helmet chin curtain add-on for effectively preventing wind, cold temperature and noise from entering into a helmet, thereby removing inconveniences when wearing a helmet, is disclosed. The chin curtain is preferably made from a resilient flexible solid material providing for an adequate elastic adjustment, allowing a fit to a wide variety of different helmets. The single piece nature of the chin curtain preferably allows for the prevention of leaks for adequate wind and noise reduction. The elastomeric nature of the material allows the chin curtain to retain its shape even when distorted from putting on and the removing the helmet.

20 Claims, 7 Drawing Sheets

HELMET CHIN CURTAIN

CROSS-REFERENCE TO RELATED APPLICATIONS

The present patent application claims the benefits of priority of commonly assigned U.S. Patent Application No. 61/928,185, entitled "Helmet Chin Curtain" and filed at the United States Patent and Trademark Office on Jan. 16, 2014.

FIELD OF THE INVENTION

The present invention generally relates to helmets, preferably but not limited to motorcycle or snowmobile helmets, and chin curtains for use in helmets, allowing the protection of the head of a person wearing the helmet and also preventing wind, cold air and noise from entering into the helmet.

BACKGROUND OF THE INVENTION

Helmet chin curtains are commonly used today to protect riders from wind or cold air and to reduce the noise. However, one of the problems of chin curtains is their permeability and the degree to which they absorb moisture which ultimately result in ice formation at below zero temperatures. Understandably, frozen chin curtains are uncomfortable due to distortions caused by frost, and are less effective to isolate the rider's head from wind and noise.

U.S. Pat. No. 6,289,521 B1 (Ikeda) discloses a helmet chin cover and helmet attached chin cover made of several parts made of different material. The chin cover disclosed in Ikeda is not adapted for being used in extreme cold weather.

European patent application no. EP 2 759 218 A1 (Kim) discloses a helmet having a neck protector. The neck protector is made of several portions with the main portion made of a fabric. Here again, this neck protector is not adapted for cold weather.

There is thus a need for a chin curtain which will provide a workable solution to mitigate at least some of the aforementioned problems.

SUMMARY OF THE INVENTION

At least some of the aforementioned problems are mitigated by a substantially non-permeable chin curtain made from solid elastomeric material.

The invention is first directed to an impermeable chin curtain for a helmet; the helmet comprising a helmet outer shell for protecting the head of a person wearing the helmet, a substantially transparent face shield hingely attached to the helmet outer shell, and a chin bar disposed below the face shield; the chin bar having an inside surface facing toward a person using the helmet, an upper edge adapted to be in close contact with the face shield when the face shield is in a close position and a lower edge surrounding the neck and/or chin of the person wearing the helmet;

the chin curtain being configured to be operatively mounted to the lower edge of the chin bar to surround the neck and/or chin of the person to prevent air and noise from flowing into the helmet, the impermeable chin curtain comprising:

a main portion extending from the chin bar toward the chin and neck of the person wearing the helmet;

a neck portion extending along a proximal edge of the main portion and adapted for being in close contact with the chin and/or neck of the person wearing the helmet; and a fixing portion extending from a distal edge of the main portion adapted to removably fix the chin curtain to the chin bar;

the main portion, the neck portion and the fixing portion of the impermeable chin curtain forming an impermeable single element made by moulding or extrusion of a polymeric material.

The invention is further directed to a protective helmet, the helmet comprising:

a helmet outer shell for protecting the head of a person wearing the helmet;

a substantially transparent face shield hingely attached to the helmet outer shell;

a chin bar connected to the helmet outer shell below the face shield, the chin bar having an inside surface facing toward the person using the helmet, an upper edge adapted to be in close contact with the face shield when the face shield is in a close position and a lower edge surrounding the neck and/or chin of the person wearing the helmet; and a chin curtain configured to be operatively mounted to the lower edge of the chin bar to surround the neck and chin of the person to prevent air and noise from flowing into the helmet, the impermeable chin curtain comprising:

a main portion extending from the chin bar toward the chin and neck of the person wearing the helmet;

a neck portion extending along a proximal edge of the main portion and adapted for being in close contact with the chin and/or neck of the person wearing the helmet; and a fixing portion extending from a distal edge of the main portion adapted to removably fix the chin curtain to the chin bar;

the main portion, the neck portion and the fixing portion of the impermeable chin curtain forming a single impermeable element made by moulding or extrusion of a polymeric material.

The impermeable chin curtain disclosed herein may further comprise a cavity in the main and fixing portions and located in a mid-section of the distal edge of the main portion for receiving a finger of the person for easing removal of the helmet.

The main portion of the chin curtain disclosed herein may have a surface defining a plurality of grooves to reinforce the main portion.

The fixing portion of the chin curtain disclosed herein may comprise at least one fixing element to secure the chin curtain to the helmet. Each fixing element may comprise an opening made through the fixing portion of the chin curtain and adapted to receive a male element extending from the inside surface of the chin bar of the helmet. The opening may be adapted for quick fixing mechanism.

Preferably, the polymeric material used for making the chin curtain disclosed herein may be flexible to allow the chin curtain to both regain its shape after distortion and/or prevent moisture from going through the material of the chin curtain. The polymeric material may comprise silicone, rubber or any impermeable material known in the art.

The main portion of the chin curtain disclosed herein may comprise at least one gutter adapted to allow a breath of the person wearing the helmet to exit from the helmet while deflecting incoming air from entering the helmet.

The protective helmet disclosed herein may be a snowmobile helmet, generally used in cold and extreme weather.

The protective helmet disclosed herein may be a modular helmet having the chin bar hingely connected to the outer shell to easily put or remove the helmet. The chin curtain remains affixed to the chin bar when the chin bar is lower to remove the helmet.

In typical yet non-limitative embodiments, the chin curtain is flexible enough and non-permeable to allow the chin curtain to both regain its shape after distortion and prevent moisture from going through.

In accordance with the principles of the present invention, the chin curtain is unitary and substantially made from polymeric material allowing an enhance protection by isolating the inside of the helmet from cold air or wind, humidity and noise. The chin curtain being made of an impermeable moulded or extruded polymeric material also allows an easy put or removal of the chin curtain in the helmet. The chin curtain is strong and resistant. The chin curtain is particularly adapted to cold temperatures, for instance when the helmet is used when driving a motorcycle or a snowmobile in cold temperature.

Understandably, the resilient nature of the material generally provides for an easy opening of the chinstrap of the helmet and generally allows the chin curtain to regain its shape back upon removal of the helmet. In addition, the single piece nature of the chin curtain will generally prevent leaks, thereby preventing air from entering into the helmet, and thereby reducing wind-generated noise in the helmet.

Other and further aspects and advantages of the present invention will be better understood by the reading of the illustrative embodiments about to be described, and various advantages not referred to herein will occur to one skilled in the art upon employment of the invention in practice.

A. According to a further aspect of the present invention, it is disclosed an impermeable chin curtain for a helmet, the helmet comprising a helmet outer shell for protecting the head of a person when wearing the helmet, a substantially transparent face shield hingedly attached to the helmet outer shell, and a chin bar disposed below the face shield; the chin bar having an inside surface facing toward a person when using the helmet, an upper edge adapted to be in close contact with the face shield when the face shield is in a close position and a lower edge surrounding the neck of the person when wearing the helmet. The chin curtain is configured to be operatively mounted to the lower edge of the chin bar to surround the neck of the person when wearing the helmet to prevent air and noise from flowing into the helmet, the impermeable chin curtain comprising: a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet and a fixing portion extending upwardly from the first edge and adapted to removably fix the chin curtain to the chin bar. The curtain portion generally covers more than half of a horizontal area having a perimeter defined by the first edge and an imaginary straight line joining extremities of the neck edge. The curtain portion, the neck edge and the fixing portion of the impermeable chin curtain forming an impermeable single element made from a polymeric material.

B According to a further aspect of the present invention, it is disclosed a protective helmet, the helmet comprising: a helmet outer shell for protecting the head of a person when wearing the helmet; a substantially transparent face shield hingedly attached to the helmet outer shell; a chin bar connected to the helmet outer shell below the face shield, the chin bar having an inside surface facing toward the person when using the helmet, an upper edge adapted to be in close contact with the face shield when the face shield is in a close position and a lower edge surrounding the neck of the person when wearing the helmet; and a chin curtain configured to be operatively mounted to the lower edge of the chin bar to surround the neck of the person when wearing the helmet to prevent air and noise from flowing into the helmet. The impermeable chin curtain generally comprises: a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet; a fixing portion extending upwardly from the first edge and adapted to removably fix the chin curtain to the chin bar; and a cavity in a mid-section of the first edge and of the fixing portion, the cavity formed from both the curtain and fixing portions for receiving a finger of the person when wearing the helmet to ease removal of the helmet, wherein the cavity has a continuous surface extending between the curtain portion and the fixing portions. The curtain portion, the neck edge and the fixing portion of the impermeable chin curtain forming a single impermeable element made from a polymeric material.

C According to a further aspect of the present invention, it is disclosed an impermeable chin curtain for a helmet, the helmet comprising a helmet outer shell for protecting the head of a person when wearing the helmet, a substantially transparent face shield hingedly attached to the helmet outer shell, and a chin bar disposed below the face shield; the chin bar having an inside surface facing toward a person using the helmet, an upper edge adapted to be in close contact with the face shield when the face shield is in a close position and a lower edge surrounding the neck of the person when wearing the helmet. The chin curtain is configured to be operatively mounted to the lower edge of the chin bar to surround the neck of the person when wearing the helmet to prevent air and noise from flowing into the helmet, the impermeable chin curtain comprising: a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet; a fixing portion having right and left side edges, the fixing portion extending upwardly from the first edge and adapted to removably fix the chin curtain to the chin bar; and a cavity in a mid-section of the first edge and of the fixing portion, the cavity formed from both the curtain and fixing portions for receiving a finger of the person when wearing the helmet to ease removal of the helmet, wherein the cavity has a continuous surface extending between the curtain portion and the fixing portions. The curtain portion, the neck edge and the fixing portion of the impermeable chin curtain forming an impermeable single element made from a polymeric material.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel helmet chin curtain will be described hereinafter. Although the invention is described in terms of specific illustrative embodiments, it is to be understood that the embodiments described herein are by way of example only and that the scope of the invention is not intended to be limited thereby.

Figure 1:
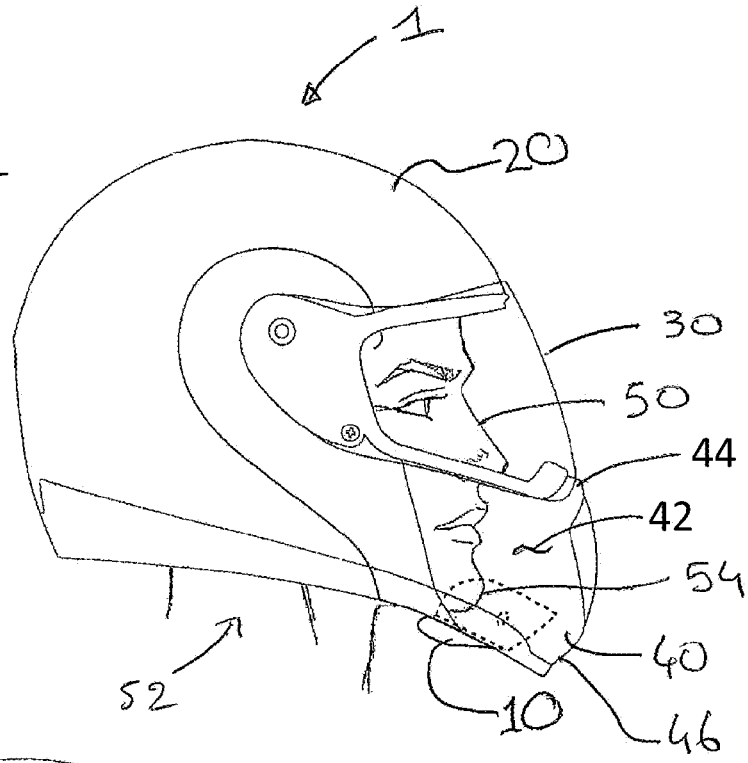
FIG. 1 is a side view of an exemplary helmet equipped with a chin curtain in accordance with one embodiment of the present invention.
Figure 2:
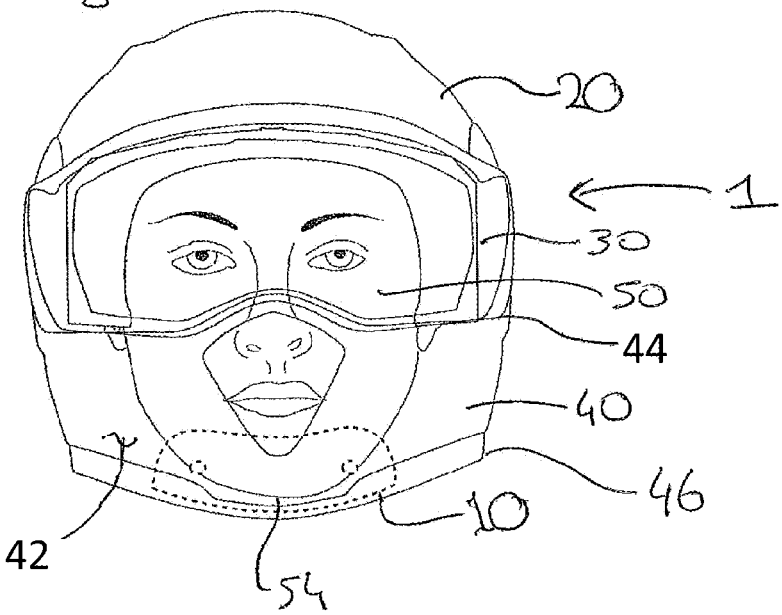
FIG. 2 is a front view of the helmet of FIG. 1.

Referring first to FIGS. 1 and 2, an exemplary helmet 1 in accordance with the principles of the present invention is illustrated. The helmet comprises a helmet outer shell 20 for protecting the head of a person 50 wearing the helmet 1, a substantially transparent face shield 30 hingely attached to the helmet outer shell 20; and a chin bar 40 connected to the helmet outer shell 20 below the face shield 30. The chin bar 40 having an inside surface 42 facing toward the person 50 using the helmet, an upper edge 44 adapted to be in close contact with the face shield 30 when the face shield is in a close position and a lower edge 46 surrounding the neck 52 and/or chin 54 of the person wearing the helmet.

The impermeable chin curtain illustrated on the Figures comprising a main portion 101, preferably semi-circular, extending from the chin bar toward the chin and/or neck of the person wearing the helmet; a neck portion 108 extending along a proximal edge 109 of the main portion 101 and adapted for being in close contact with the chin and/or neck of the person wearing the helmet; and a fixing portion, or flange 100, extending from a distal edge 112 of the main portion 101 adapted to removably fix the chin curtain 10 to the chin bar.

Figure 10:
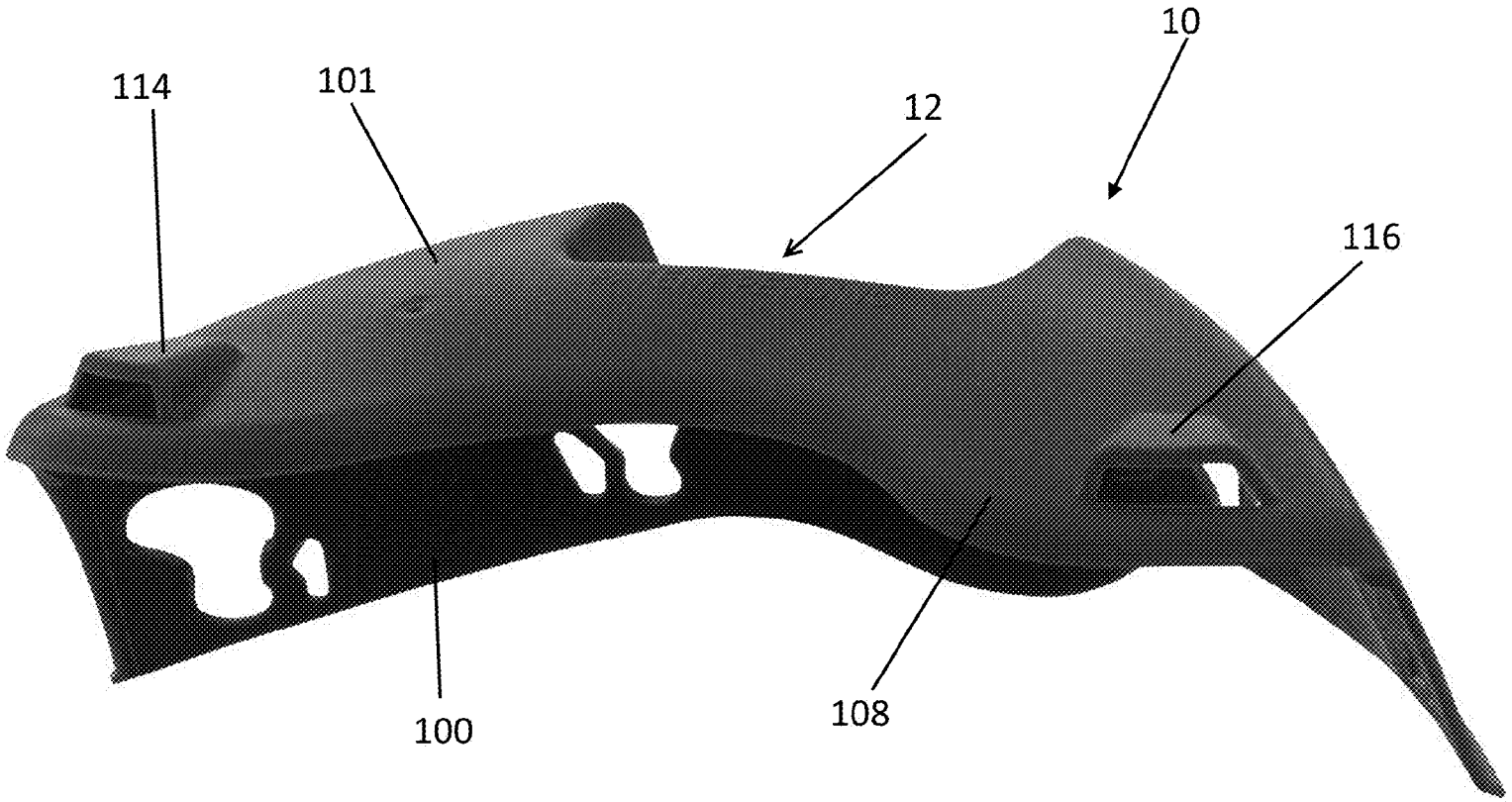
FIG. 10 is a perspective view of the chin curtain according to another embodiment of the invention showing the cavity for removing the helmet.
Figure 11:
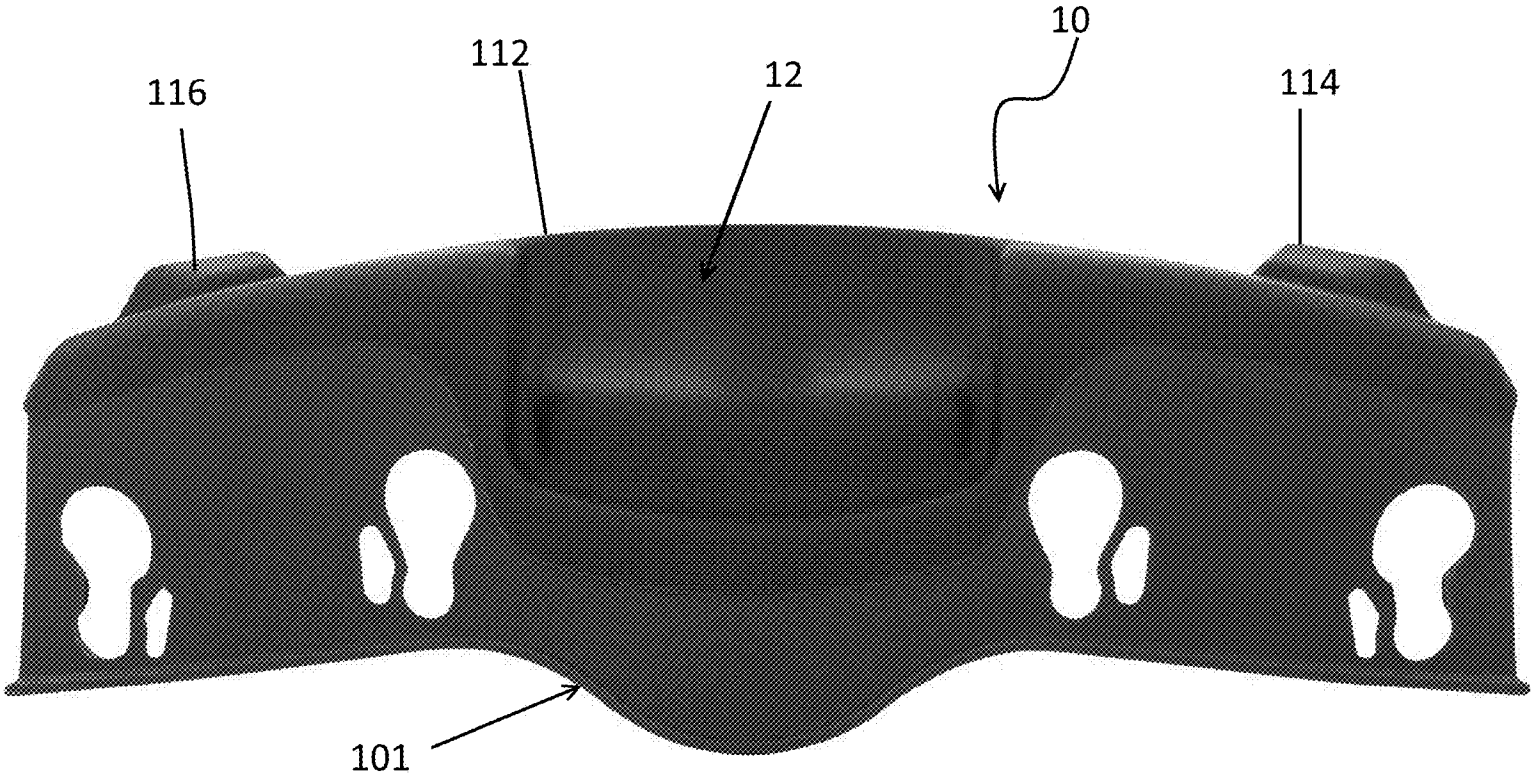
FIG. 11 is rear view of the chin curtain showed on FIG. 10.

As better illustrated on FIGS. 10 and 11, the main portion 101, the neck portion 108 and the fixing portion 100 of the impermeable chin curtain 10 form an impermeable single element made by moulding or extrusion of a polymeric material.

The chin curtain 10 is configured to be mounted into the modular helmet 20, preferably a modular helmet; preferably near or adjacent to the lower part 46 of the helmet chin bar 40.

Referring to FIGS. 10 and 11, the unitary chin curtain 10 comprises a semi-circular main portion 101 with elevated sides 100 and an intermediate curved portion 107 linking both portions. The proximal edge 109 of the main portion 101 is curved forming as such the neck portion 108 adapted for being safely and comfortably in contact with the neck of the person wearing the helmet. The main portion 101 may also present apertures 114, 116 facing the person allowing breathing but having a shape adapted to prevent the wind to enter inside the helmet.

Figure 3:
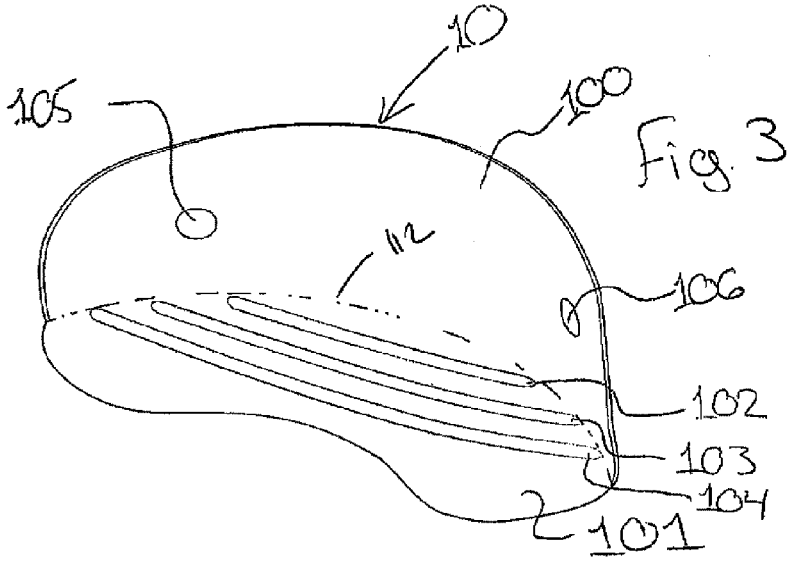
FIG. 3 is a rear perspective view of a chin curtain in accordance with a preferred embodiment of the invention.
Figure 4:
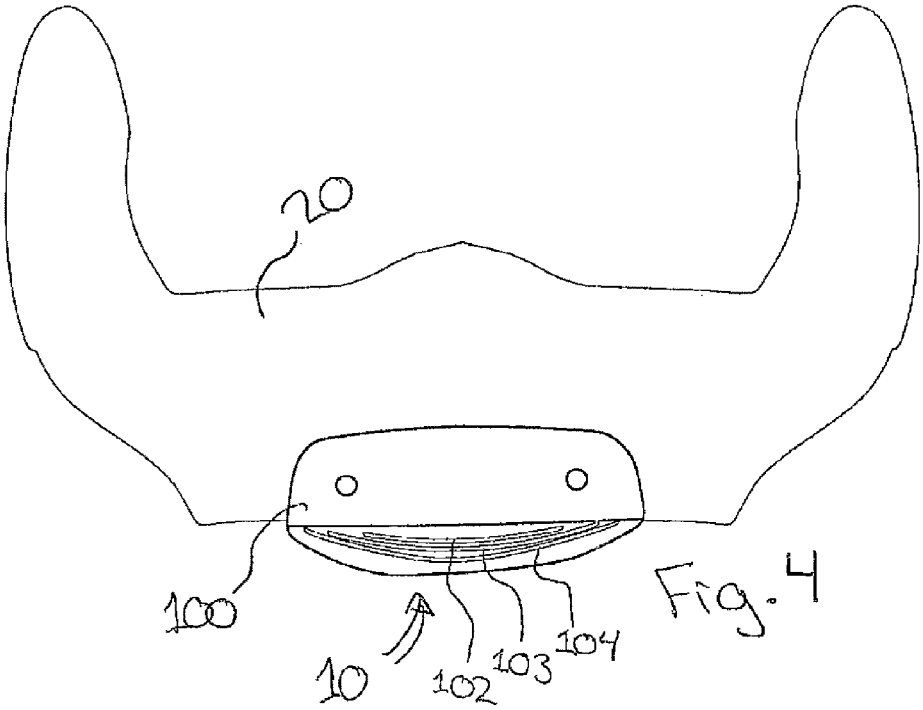
FIG. 4 is a rear view of the chin curtain of FIG. 3.
Figure 5:
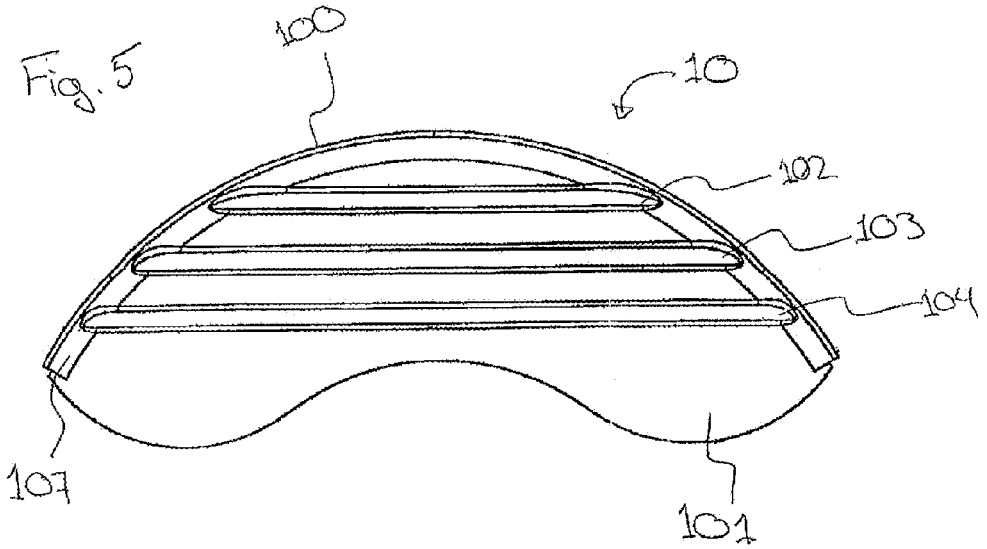
FIG. 5 is a top view of the chin curtain of FIG. 3.
Figure 6:
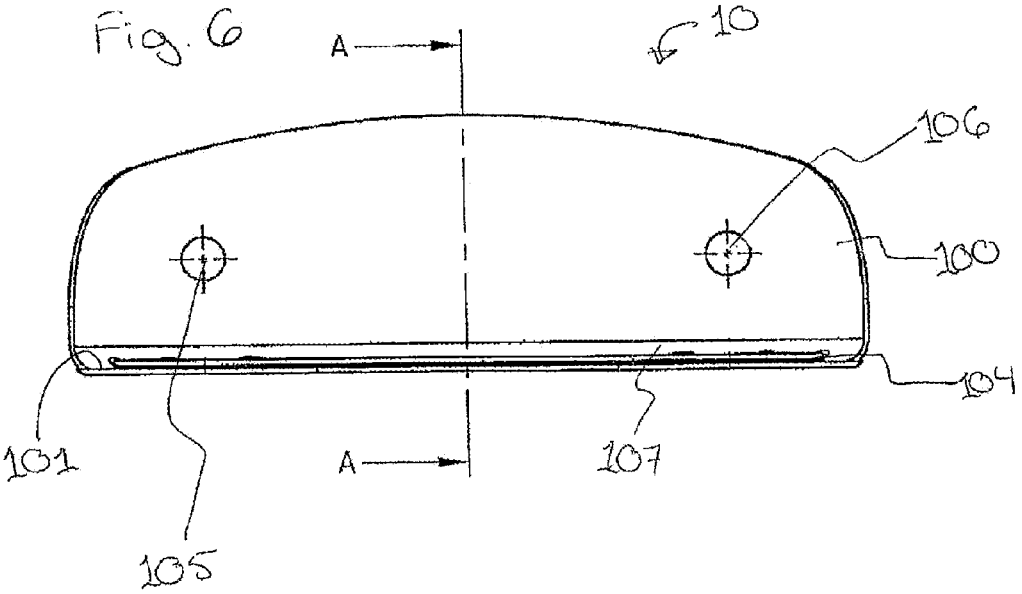
FIG. 6 is a rear view of the chin curtain of FIG. 3.
Figure 7:
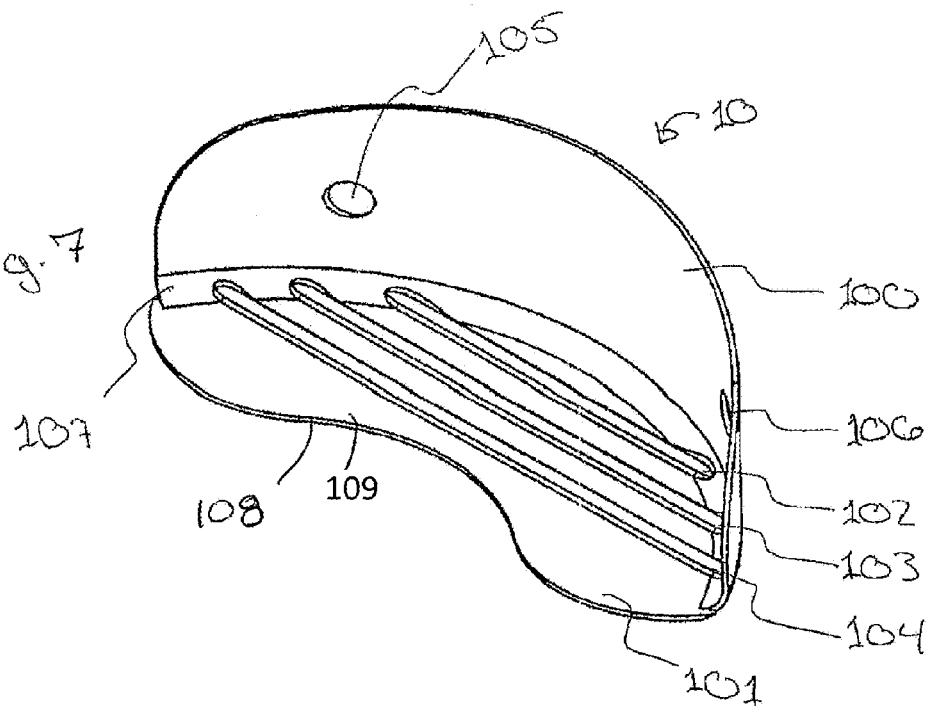
FIG. 7 is rear perspective view of the chin curtain of FIG. 3.
Figure 8:
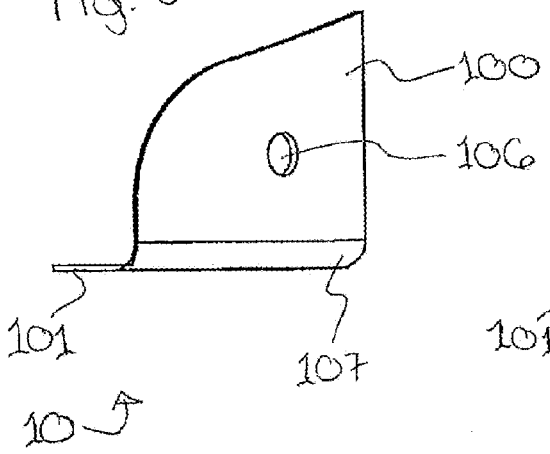
FIG. 8 is a side view of the chin curtain of FIG. 3.
Figure 9:
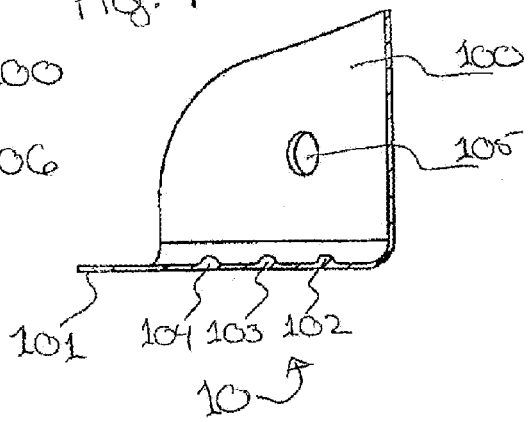
FIG. 9 is a cross-sectional side view of the chin curtain of FIG. 6 along A-A axis.

Referring particularly to FIGS. 3 and 6, the fixing portion or flange 100 is shown to have two distinct openings, on the right 105 and left 106 extremity of the chin curtain 10. The openings are used to secure the chin curtain 10 to the helmet 1. Referring now to FIG. 6, the chin curtain 10 is depicted as being symmetric about the A-A axis.

Now generally referring to FIGS. 3 to 9, the main portion 101 typically further comprises grooves 102, 104 generally enabling the chin curtain to exhibit greater strength. The grooves 102, 104 will generally reinforce the main portion 101 and allow the chin curtain 10 to retain its shape despite numerous uses of the helmet 1 equipped with the chin curtain 10.

As mentioned above, chin curtain 10 is made from a single piece of resilient elastomeric material such as, but not limited to, rubber or silicon containing material. Other materials that possess both shape memory and flexibility could also be used.

The ability of the material to regain its original shape upon physical distortion is an important feature; it will insure the same comfortable wear of the chin curtain 10 in spite of multiple uses. In addition, the flexibility in the material will enable the breath guard to fit different helmets in a comfortable manner. Such material will also allow for uses in a wide range of temperatures. Moreover, the elastomeric character of the material will also allow for an easier opening of the chinstrap. The unitary device is typically made by mold injection, whereby the silicon or rubber based material is injected in the mould (see FIGS. 10 and 11 showing the moulded or extruded chin curtain 10).

The impermeable chin curtain illustrated on FIGS. 10 and 11 comprises a cavity 12 in the main and fixing portions and located in a mid-section of the distal edge of the main portion for receiving a finger of the person for easing removal of the helmet.

The single piece nature of the chin curtain 10 will typically prevents leak, thereby effectively reducing air intake into the helmet. In addition to the non-permeable character of the material, its non-absorbent nature will prevent any moisture absorption thereby preventing ice formation at below zero temperatures use. Allowing the helmet 1 to be use throughout the year regardless of the season or the weather. The solid material will also enable easy cleaning of the noise reducing chin curtain 10.

Figure 12:
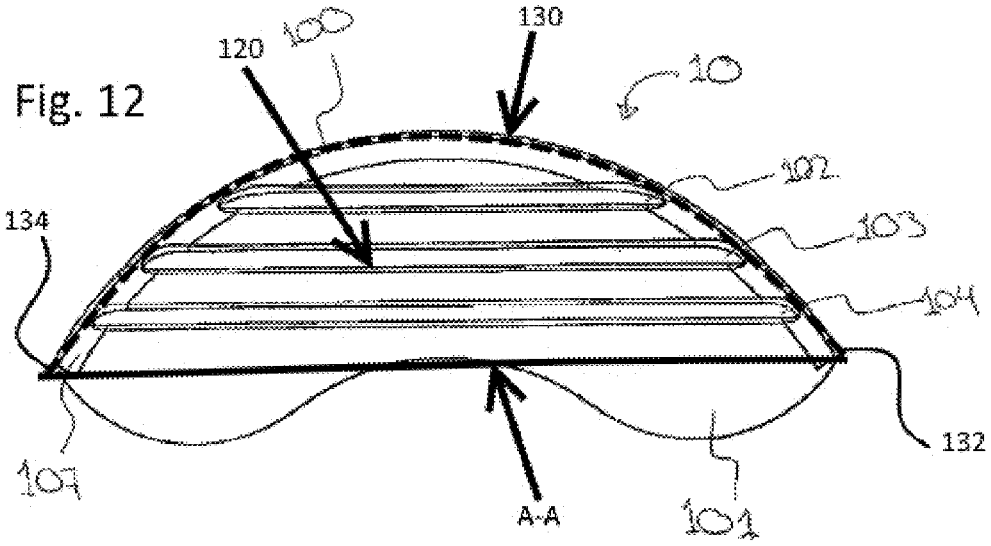
FIG. 12 is a top view of the chin curtain of FIG. 3 showing a horizontal area of the chin curtain.

Referring now to FIG. 12, the main portion 101 also referred as the curtain portion is shown covering a substantial portion, preferably more than half, of a horizontal area 120 defined by the first edge 130 of the curtain portion 101 and a straight line A-A joining the lateral extremities 132, 134 of the first edge of the curtain portion 101.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. An impermeable chin curtain for a helmet, the helmet comprising a helmet outer shell for protecting the head of a person when wearing the helmet, a substantially transparent face shield hingedly attached to the helmet outer shell, and a chin bar disposed below the face shield; the chin bar having an inside surface facing toward a person when using the helmet, an upper edge adapted to be in close contact with the face shield when the face shield is in a close position and a lower edge surrounding the neck of the person when wearing the helmet;

the chin curtain being configured to be operatively mounted to the lower edge of the chin bar to surround the neck of the person when wearing the helmet to prevent air and noise from flowing into the helmet, the impermeable chin curtain comprising:

a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet, said neck edge having two lateral extremities; and a fixing portion extending upwardly from the first edge and adapted to removably fix the chin curtain to the chin bar;

the curtain portion covering more than half of a horizontal area having a perimeter defined by the first edge and an imaginary straight line joining the two lateral extremities of the neck edge, the curtain portion, the neck edge and the fixing portion of the impermeable chin curtain forming an impermeable single element made from a polymeric material.

2. The impermeable chin curtain of claim 1, wherein the impermeable chin curtain further comprises a cavity in a mid-section of the first edge and of the fixing portion, the cavity formed from both the curtain and fixing portions for receiving a finger of the person when wearing the helmet to ease removal of the helmet, wherein the cavity has a continuous surface extending between the curtain portion and the fixing portion.

3. The impermeable chin curtain of claim 1, wherein the curtain portion of the chin curtain has a surface defining a plurality of grooves to reinforce the main portion.

4. The impermeable chin curtain of claim 1, wherein the fixing portion comprises at least one fixing element to secure the chin curtain to the helmet.

5. The impermeable chin curtain of claim 4, wherein each fixing element comprises an opening made through the fixing portion of the chin curtain and adapted to receive a male element extending from the inside surface of the chin bar of the helmet.

6. The impermeable chin curtain of claim 5, wherein the opening is adapted for quick fixing mechanism.

7. The impermeable chin curtain of claim 1, wherein the polymeric material is flexible to allow the chin curtain to both regain its shape after distortion and/or prevent moisture from going through the material of the chin curtain.

8. The impermeable chin curtain of claim 1, wherein the polymeric material comprises silicone or rubber.

9. A protective helmet, the helmet comprising:

a helmet outer shell for protecting the head of a person when wearing the helmet;

a substantially transparent face shield hingedly attached to the helmet outer shell;

a chin bar connected to the helmet outer shell below the face shield, the chin bar having an inside surface facing toward the person when using the helmet, an upper edge adapted to be in close contact with the face shield when the face shield is in a close position and a lower edge surrounding the neck of the person when wearing the helmet; and a chin curtain configured to be operatively mounted to the lower edge of the chin bar to surround the neck of the person when wearing the helmet to prevent air and noise from flowing into the helmet, the impermeable chin curtain comprising:

a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet;

a fixing portion extending upwardly from the first edge and adapted to removably fix the chin curtain to the chin bar; and a cavity in a mid-section of the first edge and of the fixing portion, the cavity formed from both the curtain and fixing portions for receiving a finger of the person when wearing the helmet to ease removal of the helmet, wherein the cavity has a continuous surface extending between the curtain portion and the fixing portion;

the curtain portion, the neck edge and the fixing portion of the impermeable chin curtain forming a single impermeable element made from a polymeric material.

10. The protective helmet of claim 9, wherein the curtain portion of the chin curtain has a surface defining a plurality of grooves to reinforce the curtain portion.

11. The protective helmet of claim 9, wherein the fixing portion comprises at least one fixing element to secure the chin curtain to the helmet.

12. The protective helmet of claim 11, wherein each fixing element comprises an opening made through the fixing portion of the chin curtain and adapted to receive a male element extending from the inside surface of the chin bar of the helmet.

13. The protective helmet of claim 12, wherein the opening is adapted for quick fixing mechanism.

14. The protective helmet of claim 9, wherein the polymeric material is flexible to allow the chin curtain to both regain its shape after distortion and/or prevent moisture from going through the material of the chin curtain.

15. The protective helmet of claim 9, wherein the polymeric material comprises silicone or rubber.

16. The protective helmet of claim 9, wherein the curtain portion comprises at least one gutter adapted to allow a breath of the person wearing the helmet to exit from the helmet while deflecting incoming air from entering the helmet.

17. The protective helmet of claim 9, wherein the helmet is a helmet for snowmobile users.

18. The protective helmet of claim 9, wherein the helmet is a modular helmet having the chin bar hingedly connected to the outer shell to easily put or remove the helmet.

19. The protective helmet of claim 9, wherein the curtain portion covers more than half of a horizontal area having a perimeter defined by the first edge and an imaginary straight line joining extremities of the first edge.

20. An impermeable chin curtain for a helmet, the helmet comprising a helmet outer shell for protecting the head of a person when wearing the helmet, a substantially transparent face shield hingedly attached to the helmet outer shell, and a chin bar disposed below the face shield; the chin bar having an inside surface facing toward a person using the helmet, an upper edge adapted to be in close contact with the face shield when the face shield is in a close position and a lower edge surrounding the neck of the person when wearing the helmet;

the chin curtain being configured to be operatively mounted to the lower edge of the chin bar to surround the neck of the person when wearing the helmet to prevent air and noise from flowing into the helmet, the impermeable chin curtain comprising:

a curtain portion having a first edge substantially matching the shape of the chin bar, the chin curtain extending from the first edge toward the neck of the person when wearing the helmet forming a neck edge, the neck edge extending along a proximal edge of the curtain portion and adapted for being in close contact with the neck of the person when wearing the helmet;

a fixing portion extending upwardly from the first edge and adapted to removably fix the chin curtain to the chin bar; and a cavity in a mid-section of the first edge and of the fixing portion, the cavity formed from both the curtain and fixing portions for receiving a finger of the person when wearing the helmet to ease removal of the helmet, wherein the cavity has a continuous surface extending between the curtain portion and the fixing portion;

the curtain portion, the neck edge and the fixing portion of the impermeable chin curtain forming an impermeable single element made from a polymeric material.

* * * * *